United States Patent [19]

Hashizume et al.

[11] Patent Number: 4,707,893

[45] Date of Patent: Nov. 24, 1987

[54] FABRIC FASTENER

[75] Inventors: Masatora Hashizume, Ikeda; Eiichi Kudoh, Osaka; Setuzo Fujiwara, Daito; Hitomi Shiomi, Osaka, all of Japan

[73] Assignee: Kanebo Bell-Touch, Ltd., Osaks, Japan

[21] Appl. No.: 858,963

[22] Filed: May 2, 1986

[30] Foreign Application Priority Data

May 8, 1985 [JP] Japan ..... 60-98445

[51] Int. Cl.[4] ..... A44B 13/00

[52] U.S. Cl. ..... 24/446; 24/450; 24/445

[58] Field of Search ..... 24/445, 446, 448, 449, 24/450, 451, 452; 2/DIG. 6

[56] References Cited

U.S. PATENT DOCUMENTS

| | | | |
|---|---|---|---|
| 3,408,705 | 11/1968 | Kayser et al. | 24/452 |
| 3,527,001 | 9/1970 | Kleemeir et al. | 24/446 |
| 3,577,607 | 5/1971 | Ikoma | 24/445 |
| 3,708,833 | 1/1973 | Ribich et al. | 24/450 |
| 3,746,604 | 7/1973 | Reynolds | 24/448 |
| 3,849,840 | 11/1974 | Yamada et al. | 24/448 |
| 3,863,304 | 2/1975 | Brumlik | 24/445 |
| 3,900,652 | 8/1975 | Uraya et al. | 24/450 |
| 4,169,303 | 10/1979 | Lemelson | 24/446 |

FOREIGN PATENT DOCUMENTS

| | | |
|---|---|---|
| 35522 | 10/1957 | Japan . |
| 465417 | 2/1967 | Japan . |

*Primary Examiner*—Victor N. Sakran
*Attorney, Agent, or Firm*—Paul and Paul

[57] ABSTRACT

A fabric fastener suitable for industrial use such as for fixing a porous working element to a rotor of a polisher, in which a male member has at least two groups of projections on one surface thereof, a first group having a hook or mushroom shape and a second group having a straight needle shape and a taller height than the projection of the first group, thereby the needle shape projection positively penetrates the interior of the porous mating member, while the hook or mushroom shape projection passively engages with a recess or a gap of the mating member, thus ensuring a proper engagement between both members.

8 Claims, 11 Drawing Figures

FABRIC FASTENER

BACKGROUND OF THE INVENTION

1. Field of the Invention

The present invention relates to a fabric fastener having a plurality of male projections on its surface and utilized for fastening a mating object having a rough surface by the engagement of the male element with the latter surface.

2. Description of Related Arts

A fabric fastener of the described type is widely known. Typical examples thereof are disclosed, for example, in Japanese Examined Patent Publication Nos. 35-552 and 46-5417, in which the fastener comprises a male member with a plurality of hook or mushroom shape projections as shown in FIG. 1 projecting from a surface thereof and a female member with a plurality of loops on a surface thereof, whereby both members are releaseably engaged with each other when the male and female members are piled and pressed together, thus achieving the fastening effect between the both members.

The above type of the fabric fastener is mainly used for fastening clothing, diapers, shoes or the like due to its softness. Recently, however, an increasing requirement for the industrial use thereof has arisen, such as for fixing an interior of automobile, or for detachably fastening a working element to a rotor of a polisher or a grinder. Especially, in the case of the polisher, the working element is a mat in which fibers are randomly oriented and fixed to each other with adhesive to form a relatively porous structure, or a sponge formed of a synthetic resin foam. For fastening such an element, it is sufficient to use the male member only, without the female member, because the mat or sponge type working element itself acts as a female member. In such a case, the male member of the fabric fastener is required to have a specific property different form that of the conventional fastener comprising two members selected to be most suitably engageable to each other. That is, the single member must be engageable with any type of working elements, each made of a different material and having a different porosity, hardness, and elasticity from the other.

Under such circumstances, according to experiments conducted by the present inventors, it was found that the conventional male member is unsatisfactory for fastening a working element formed of a mat or a sponge, because, on one hand, it is difficult for the hook shape projection to enter a gap between th mat forming fibers or a recess of the sponge and, conversely, although the mushroom shape projection is relatively easily engageable with the gap or void of the working element, it is difficult to detach the same therefrom and, if this is forcibly carried out, the engaging surfaces are liable to be damaged and are quickly worn out.

SUMMARY OF THE INVENTION

It is an object of the present invention to eliminate the abovesaid drawbacks of the conventional fastener.

It is another object of the present invention to provide a unique fabric fastener suitable for industrial use.

These objects can be achieved, in accordance with the present invention, by a fabric fastener comprising only a male member suitable for fastening a working element having a rough surface formed of a porous material such as a fibrous mat or a foamed sponge, characterized in that the male member has at least two groups of projections on one surface thereof, a first group being of a hook or mushroom shape and a second group being of a straight needle shape and taller than the projection of the first group.

The projection is preferably made of a monofilament of synthetic fiber forming polymer, such as polyamide including nylon 6, nylon 66, nylon 610, nylon 11 or copolymer thereof; polyester such as polyethylene terephthalate obtained by condensation of aromatic dicarbonic acid and glycon; or polyolefin such as polypropylene or polyethylene.

The two groups of the projections may be arranged so that a row of one group is alternated with another row of the other group on the surface of the male member.

BRIEF DESCRIPTION OF THE DRAWINGS

These and other features and advantages of the present invention will be apparent from the following description with reference to the accompanying drawings illustrating the preferred embodiments of the present invention: wherein.

DESCRIPTION OF THE PREFERRED EMBODIMENTS

Figure 1A:
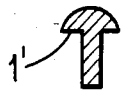
PRIOR ART Fig. 1A
FIG. 1 is an elevational sectional view of typical male projections according to the prior art, (a) and (b) being a mushroom shape and a hook shape, respectively.
Figure 1B:
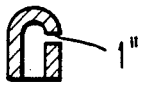
PRIOR ART Fig. 1B

In FIGS. 1*a* and 1*b*, the projections have rearwardly facing outer end portions 1′ and 1″, respectively.

Figure 2:
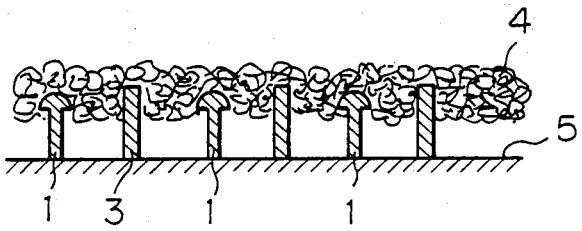
FIG. 2 is a sectional view of a fastener according to the present invention illustrating the engagement between the male member and a fibrous mat.

With reference to FIG. 2, reference numeral 4 designates a fibrous mat manufactured by random-webbing of a filamentary material. The component fibers of the mat 4 are strengthened and adhered to each other by a suitable resin to form a disc-like working element of a polisher or a grinder. When fixed to a rotor (not shown), the mat 4 is pressed onto a male member 5 according to a fabric fastener of the present invention attached, as a holder, to a surface of the rotor by a suitable means such as an adhesive. The male member 5 has a plurality of male projections classified into two groups, a first one being a mushroom shape projection 1 and a second one being a straight needle shape projection 3, throughout one surface thereof. The needle shape projection 3 is taller in height than the mushroom shape projection 1. According to this structure both of the projections 1 and 3 penetrate the interior of the mat 4 through a gap between the component fibers. In this embodiment, a peeling resistance of the fastener is insured by the mushroom shape projection 1 because the fibers of the mat 4 are entangled around a throat of the mushroom 1, and the shear resistance is further enhanced by a deeper penetration of the needle 3 into the mat 4, whereby fixation of the mat 4 to the male member 5, and therefore, on the rotor of the polisher, is achieved.

Figure 3:
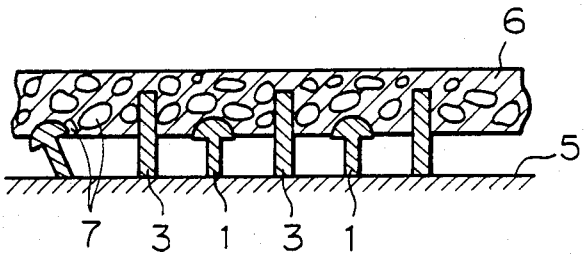
FIG. 3 is a similar view to FIG. 2 illustrating the engagement between the male member and a foamed sponge.

In FIG. 3, a foamed sponge 6 made of synthetic polymer such as polyvinyl acetal is utilized as a mating member in place of the fibrous mat 4 in the preceding embodiment. It is apparent that the needle 3 positively sticks into the sponge 6 and the mushroom 1 is partly engaged with a recess 7 on the surface of the sponge 6. The peeling and shear resistances are sufficient, in this case, although lower than those of the preceding embodiment, because the working element of the polisher is mainly used under a condition wherein it is pressed against a floor or wall.

Figure 4:
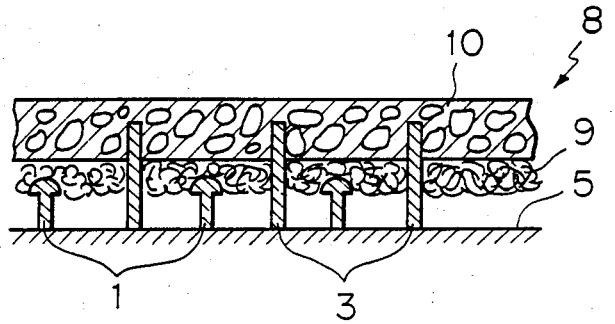
FIG. 4 is also a similar view to FIGS. 2 and 3 illustrating the engagement between the male member and a composite material formed of a fibrous mat and a sponge.

In FIG. 4, the mating member is a composite material 8 formed of a thin fibrous mat 9 and a sponge 10 integrally layered with each other, to which the male member 5 according to the present invention is applied so that the needle shape projection 3 passes through the mat 9 and penetrates the sponge 10 and, on the other hand, the mushroom shape projection 1 is embedded in the gap between the component fibers of the mat 9, thus ensuring the engagement between the male member 5 and the mating member 9.

Figure 5:
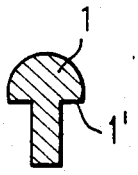
FIGS. 5 through 7 illustrate elevational sectional views of preferable male projections utilized for the present invention.
Figure 6:
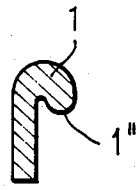
Figure 7:
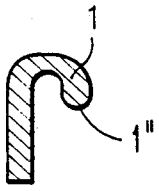

The male projection of the first group utilized for the present invention should not be limited to the above-stated mushroom shape but may be the shapes shown in FIGS. 5, 6, and 7 having rearwardly facing outer end portions 1' and 1'', as shown. These male projections can be formed by a method based on the disclosure in Japanese Examined Patent Publication No. 46-5417, if the material polymer for the projection is suitably selected and the process conditions, such as water content, processing temperature, or processing speed, are properly decided.

The male projection is preferably formed of a monofilament of thermoplastic fiber-forming synthetic polymer such as polyamide, including nylon 6, nylon 66, nylon 610, nylon 11 or a copolymer thereof; polyester such as polyethylene terephthalate obtained by condensation of aromatic dicarbonic acid and ethylene glycol; or polyolefine such as polyethylene or polypropylene.

Particularly, the most preferable polymer for the so-called mushroom shape male projection is polypropylene, and that for the needle shape projection is polyamide or polyester. A suitable thickness for the former is in a range of from 300 to 1500 denier, and for the latter, a thickness of from 600 to 2500 denier. A suitable height for the former is of a range from 4 to 7 mm, and for the latter, a height in a range of from 5 to 10 mm; and a suitable L/D ratio is in a range of from 10 to 25 for both projections.

Figure 8:
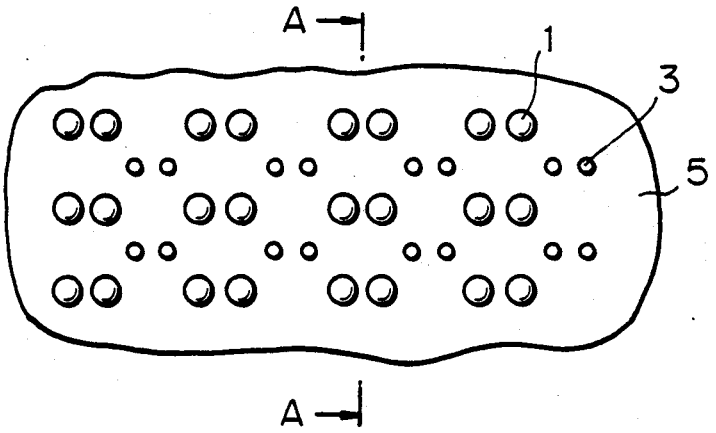
FIGS. 8 and 9 are a plan view and a sectional view of one example of the arrangement of the male projections on the base fabric according to the present invention, respectively.
Figure 9:
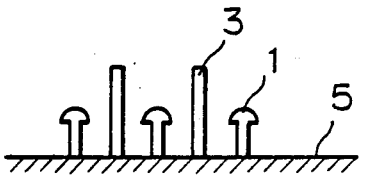
Figure 10:
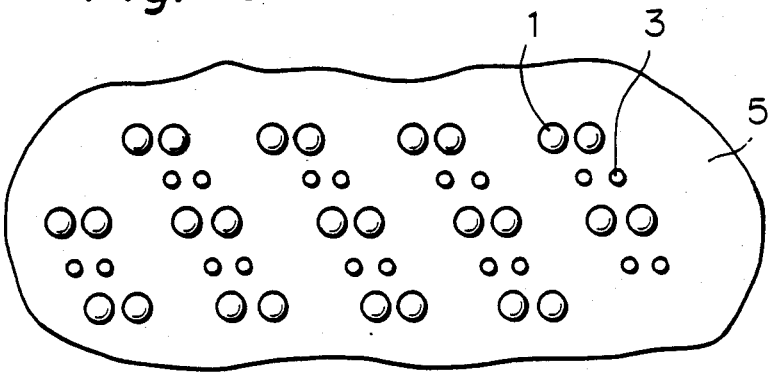
FIG. 10 is a view similar to FIG. 8, illustrating another example of the arrangement of the male projections.

The male projection is originated from a pile yarn woven into a base fabric, which is cut to have a suitable length and back-coated by a suitable resin in a conventional manner. The arrangement of the mushroom shape projection and the needle shape projection on the base fabric should be designed in accordance with the purpose of the fastener. However, the arrangements illustrated in FIGS. 8, 9 and 10 are preferable for general purposes, in which a row of the projections of one group is alternated with the projection of the other group. In this regard, FIGS. 8 and 9 show a plain weave arrangement and FIG. 10 shows a twill weave arrangement.

A density of the male projections on the base fabric is preferably in a range of from 200 to 450 ends per square inch. If the density is more than the upper limit, broken pieces of the mat fibers or sponge tend to stay between the projections and will not drop out therefrom, with the result that, after the repeated use, the insertion of the projection into the mating member is inhibited. On the other hand, a lesser density leads to a poor engagement between the two members.

We claim:

1. A fabric fastener comprising only male members suitable for fastening a working element having a rough surface formed of a porous material, characterized in that the male members include at least two groups of projections from one surface thereof, a first group having rearwardly facing outer end portions and a second group being of a straight needle shape and taller than the projection of the first group, with the projections of the first group comprising means, when engaged with a working element, for at least partial engagement into a surface of the working element, and with said projections in the second group comprising means when engaged with a working element, for substantial penetration of the interior of the working element, with said projections in said first group and said second group comprising means facilitating peeling resistance and shear resistance, respectively, upon application of outside forces to the fastener.

2. A fabric fastener as defined by claim 1, characterized in that the projection is made of a monofilament of synthetic fiber forming polymer.

3. A fabric fastener as defined by claim 1, characterized in that the first and second groups of the projections are arranged so that a row of the first group is alternated with another row of the second group on the surface of the male member.

4. A fabric fastener as defined by claim 1, characterized in that the projection of the first group is formed of a polypropylene monofilament having a thickness in a range of from 300 denier to 1500 denier and that of the second group is formed of a polyamide monofilament having a thickness in a range of from 600 denier to 2500 denier, and in that both projections have a ratio of L/D in a range of from 10 to 25.

5. The fastener of claim 1, wherein the members of the first group have outer ends of generally mushroom shape.

6. The fastener of claim 1, wherein the members of the first group have outer ends of generally hook shape.

7. The fastener of claim 2, wherein the polymer is selected from the group consisting of polyamide, polyester, and polyolefin.

8. A fabric fastener as defined by claim 1, characterized in that the projection of the first group is formed of a polyproplylene monofilament having a thickness in a range of from 300 denier to 1500 denier and that of the second group is formed of a polyester monofilament having a thickness in a range of from 600 denier to 2500 denier, and in that both projections have a ratio of L/D in a range of from 10 to 25.

* * * * *